US010766290B2

(12) United States Patent
Tago et al.

(10) Patent No.: US 10,766,290 B2
(45) Date of Patent: Sep. 8, 2020

(54) BOOKBINDING MACHINE

(71) Applicant: Horizon International Inc., Takashima-shi, Shiga (JP)

(72) Inventors: Shigeyoshi Tago, Takashima (JP); Shigenobu Fukuda, Takashima (JP); Shinya Kitayama, Takashima (JP); Kosuke Fujiwara, Takashima (JP)

(73) Assignee: HORIZON INTERNATIONAL INC., Shiga (JP)

( * ) Notice: Subject to any disclaimer, the term of this patent is extended or adjusted under 35 U.S.C. 154(b) by 0 days.

(21) Appl. No.: 16/473,873

(22) PCT Filed: Apr. 18, 2017

(86) PCT No.: PCT/JP2017/015603
§ 371 (c)(1),
(2) Date: Jun. 26, 2019

(87) PCT Pub. No.: WO2018/193523
PCT Pub. Date: Oct. 25, 2018

(65) Prior Publication Data

US 2020/0147991 A1 May 14, 2020

(51) Int. Cl.
*B42C 9/00* (2006.01)
*B42C 19/08* (2006.01)

(52) U.S. Cl.
CPC ..... *B42C 9/0006* (2013.01); *B42C 9/00* (2013.01); *B42C 19/08* (2013.01)

(58) Field of Classification Search
CPC ..... B42C 9/00; B42C 9/0006
(Continued)

(56) References Cited

U.S. PATENT DOCUMENTS 4,707,215 A * 11/1987 Scarlata ..... B42C 9/00 412/37
5,418,009 A * 5/1995 Raterman ..... B42C 9/0006 412/8

(Continued)

FOREIGN PATENT DOCUMENTS

DE 4121792 A1 * 1/1993 ..... B42C 9/0006
EP 2319707 A1 * 5/2011 ..... B42C 9/0006
JP 2009-113407 A 5/2009

OTHER PUBLICATIONS

EP2319707A1 English Translation (Year: 2011).*

(Continued)

*Primary Examiner* — Kyle R Grabowski
(74) *Attorney, Agent, or Firm* — Westman, Hattori, Daniels & Adrian, LLP

(57) ABSTRACT

A bookbinding machine calculates a rotational speed coefficient, which represents the percent change of a rotational speed of a pump 6 relative to the reference rotational speed of the pump, depending on a thickness of a book block P to be bound and a conveying speed of a clamper by use of a first function defining a relationship between the thickness of the book block and the rotational speed coefficient and a second function defining a relationship between the rotational speed coefficient and the conveying speed of the clamper, calculates the set value of the rotational speed of the pump based on the rotational speed coefficients and the reference rotational speed, and sets the rotational speed of the pump according to the set value of the rotational speed.

2 Claims, 5 Drawing Sheets

(58) Field of Classification Search
USPC ..... 402/37
See application file for complete search history.

(56) References Cited

U.S. PATENT DOCUMENTS

| | | | | |
|---|---|---|---|---|
| 6,474,391 | B1 * | 11/2002 | Schmidt | B42C 9/0006 412/37 |
| 6,881,443 | B2 * | 4/2005 | Baltensperger | B42C 9/0006 427/208.6 |
| 6,960,261 | B2 * | 11/2005 | Westermann | B42C 9/0006 412/37 |
| 2009/0025881 | A1 * | 1/2009 | Westermann | B42C 9/00 156/379.6 |
| 2014/0017038 | A1 * | 1/2014 | Knoefel | B42C 9/0006 412/6 |

OTHER PUBLICATIONS

International Search Report dated Jun. 13, 2017, issued in counterpart International Application No. PCT/JP2017/015603 (2 pages).

* cited by examiner

BOOKBINDING MACHINE

TECHNICAL FIELD

The present invention relates to a bookbinding apparatus, in particular, a perfect bookbinding machine provided with a nozzle type adhesive application mechanism.

BACKGROUND ART

In perfect bookbinding machines, EVA (Ethylene Vinyl Acetate) hot-melt adhesive (referred to as "EVA adhesive" hereinafter) is generally used. The EVA adhesive can be easily treated because it infinitely repeats the cycle of melting by heating and hardening by cooling on the one hand, and has a defect of unsatisfied adhesion force on the other hand.

Hence PUR (Poly Urethane Reactive) hot-melt adhesive (referred to as "PUR adhesive" hereinafter), whose adhesion force is much stronger than that of the EVA adhesive, has attracted attention in recent years. The PUR adhesive has a characteristic that it hardens by reacting with water contained in air or paper and never softens even when heated if once it hardens.

Accordingly, in a bookbinding machine using the PUR adhesive, an adhesive application mechanism suitable for the characteristic of the PUR adhesive is required.

That is to say, in the case of manufacturing the same product in large quantities, just like a bookbinding machine using the EVA adhesive, a roller type adhesive application mechanism is provided and the PUR adhesive is applied to a spine of a book block by one or more adhesive application rollers while a clamper by which the book block is gripped in a standing state passes over the roller type adhesive application mechanism.

On the other hand, in the case of manufacturing a wide variety of products in small quantities, a nozzle type adhesive application mechanism rather than the roller type adhesive application mechanism is provided and the PUR adhesive is applied by spraying the PUR adhesive from a spray nozzle to a spine of a book block (see, for example, Patent Document 1).

The nozzle type adhesive application mechanism comprises a spray nozzle directed toward a path of conveying a book block, an adhesive supply source, an adhesive supply pipe for supplying the adhesive from the adhesive supply source to the spray nozzle, and a pump connected to the adhesive supply pipe. By using this adhesive application mechanism, the adhesive is sprayed from the spray nozzle and applied to a spine of the book block while a book block gripped by a clamper is conveyed along a conveying path.

Incidentally, because the amount of adhesive to be applied to a book block's spine changes depending on the thickness of the book block, the nozzle type adhesive application mechanism requires changing a rotational speed of the pump to control the amount of adhesive fed into the spray nozzle. In this case, the thickness of adhesive applied to the book block's spine changes depending on change of a conveying speed of the clamper even if the amount of adhesive fed into the spray nozzle is the same.

Accordingly, taking not only the thickness of the book block but also the conveying speed of the clamper into consideration, the rotational speed of the pump should be controlled.

Also, because sheets or signatures making up the respective book blocks have different qualities and thicknesses and different kinds of adhesive have different characteristics, the thickness of adhesive to be applied to the book block's spine should be determined taking not only the thickness of the book block but also those conditions into consideration.

Furthermore, because an appearance of a product (book) is subjectively evaluated and a criteria of the evaluation varies for each of users, it may be desired by the users to set the thickness of adhesive to be applied to the book block's spine in a manner such that products suitable for tastes of the users can be obtained.

Hence, the users conduct test operations of the bookbinding machine, makeup a table of rotational speed values of the pump of the nozzle type adhesive application mechanism based on results of the test operations and perform initial setting of the rotational speed of the pump by using the table prior to an operation of the bookbinding machine.

However, the preparation of this table is achieved by bookbinding actually while changing combinations of the thickness of the book block, the rotational speed of the pump and the conveying speed of the clamper and so on in various ways, which requires a long time and considerable labor and imposes a heavy burden on the users.

PRIOR ART DOCUMENTS

Patent Documents

Patent Document 1: JP 2009-113407 A

SUMMARY OF THE INVENTION

Problems to be Solved by the Invention

It is, therefore, an object of the present invention to achieve an easy and fast initial setting of a nozzle type adhesive application mechanism of a bookbinding machine.

Means for Solving the Problems

In order to resolve the object, the present invention provides A bookbinding machine having: a nozzle type adhesive application mechanism arranged under a path of conveying a book block to be bound; and at least one clamper adapted to grip the book block while keeping the book block in a standing state and convey the book block along the path, wherein the nozzle type adhesive application mechanism comprises: a spray nozzle directed toward the path; an adhesive supply source; an adhesive supply pipe for supplying adhesive from the adhesive supply source to the spray nozzle; a pump connected to the adhesive supply pipe, whereby the adhesive sprayed from the spray nozzle is applied to a spine of the book block during the conveyance of the book block along the path, characterized in that the bookbinding machine further comprises: a pump rotational speed setting section calculating a rotational speed coefficient depending on both of a thickness of the book block and a set value of a conveying speed of the at least one clamper by use of first and second functions, the rotational speed coefficient representing the percent change of a rotational speed of the pump relative to the reference rotational speed of the pump, the first function defining a relationship between the thickness of the book block and the rotational speed coefficient, the second function defining a relationship between the conveying speed of the at least one clamper and the rotational speed coefficient, the pump rotational speed setting section further calculating a set value of the rotational speed of the pump based on both the rotational speed coefficient and the reference rotational speed of the pump, and performing initial setting of the rotational speed of the pump according to the set value of the rotational speed.

According to a preferred embodiment of the present invention, the bookbinding machine further comprises: an input section for receiving inputs of correction magnifications of the rotational speed coefficient for two or more different thicknesses of the book block; and a function generation section generating as an alternative to the first function a third function based on the correction magnifications inputted into the input section, the third function being used for calculating the corrected rotational speed coefficient depending on the thickness of the book block, wherein, when the correction magnifications of the rotational speed coefficient are inputted into the input section prior to an operation of the bookbinding machine, the pump rotational speed setting section calculates the corrected rotational speed coefficient depending on the thickness of the book block using the third function, and further calculates the set value of the rotational speed of the pump based on the corrected rotational speed coefficient, and the rotational speed coefficient depending on the set value of the conveying speed of the at least one clamper calculated using the second function, and the reference rotational speed.

According to another preferred embodiment of the present invention, the bookbinding machine further comprises:

an input section for receiving inputs of correction magnifications of the rotational speed coefficient for two or more different conveying speeds of the at least one clamper; and a function generation section generating as an alternative to the second function a fourth function based on the correction magnifications inputted into the input section, the fourth function being used for calculating the corrected rotational speed coefficient depending on the conveying speed of the at least one clamper, wherein, when the correction magnifications of the rotational speed coefficient are inputted into the input section prior to an operation of the bookbinding machine, the pump rotational speed setting section calculates the corrected rotational speed coefficient depending on the set value of the conveying speed of the at least one clamper using the fourth function, and further calculates the set value of the rotational speed of the pump based on the corrected rotational speed coefficient, and the rotational speed coefficient depending on the thickness of the book block calculated using the first function, and the reference rotational speed.

According to further preferred embodiment of the present invention, the bookbinding machine further comprises: an input section for receiving inputs of both first correction magnifications of the rotational speed coefficient for two or more different thicknesses of the book block and second correction magnifications of the rotational speed coefficient for two or more different conveying speeds of the at least one clamper; and a function generation section generating as an alternative to the first function a third function based on the first correction magnification inputted into the input section, the third function being used for calculating the corrected first rotational speed coefficient depending on the thickness of the book block, and generating as an alternative to the second function a fourth function based on the second correction magnification inputted into the input section, the fourth function being used for calculating the corrected second rotational speed coefficient depending on the conveying speed of the at least one clamper, wherein, when the first and second correction magnifications are inputted into the input section prior to an operation of the bookbinding machine, the pump rotational speed setting section calculates the corrected first rotational speed coefficient depending on the thickness of the book block using the third function and the corrected second rotational speed coefficient depending on the set value of the conveying speed of the at least one clamper using the fourth function, and further calculates the set value of rotational speed of the pump based on the corrected first and second rotational coefficients and the reference rotational speed.

Effect of the Invention

According to the present invention, the rotational speed coefficient depending on both the thickness of the book block to be bound and the set value of the conveying speed of the clamper is calculated using the first function which defines the relationship between the thickness of the book block and the rotational speed coefficient of the pump (representing the percent change of the rotational speed of the pump relative to the reference rotational speed of the pump) and the second function which defines the relationship between the conveying speed of the clamper and the rotational speed coefficient of the pump, and furthermore the set value of the rotational speed of the pump is calculated based on both the rotational speed coefficient and the reference rotational speed, and then the initial setting of the rotational speed of the pump is automatically performed according to the set value of the rotational speed.

Thus an easy and quick initial setting of the nozzle type adhesive application mechanism is achieved so that user's workload is reduced considerably.

BEST MODE FOR CARRYING OUT THE INVENTION

A preferred embodiment of the present invention will be explained below with reference to the accompanying drawings.

Figure 1:
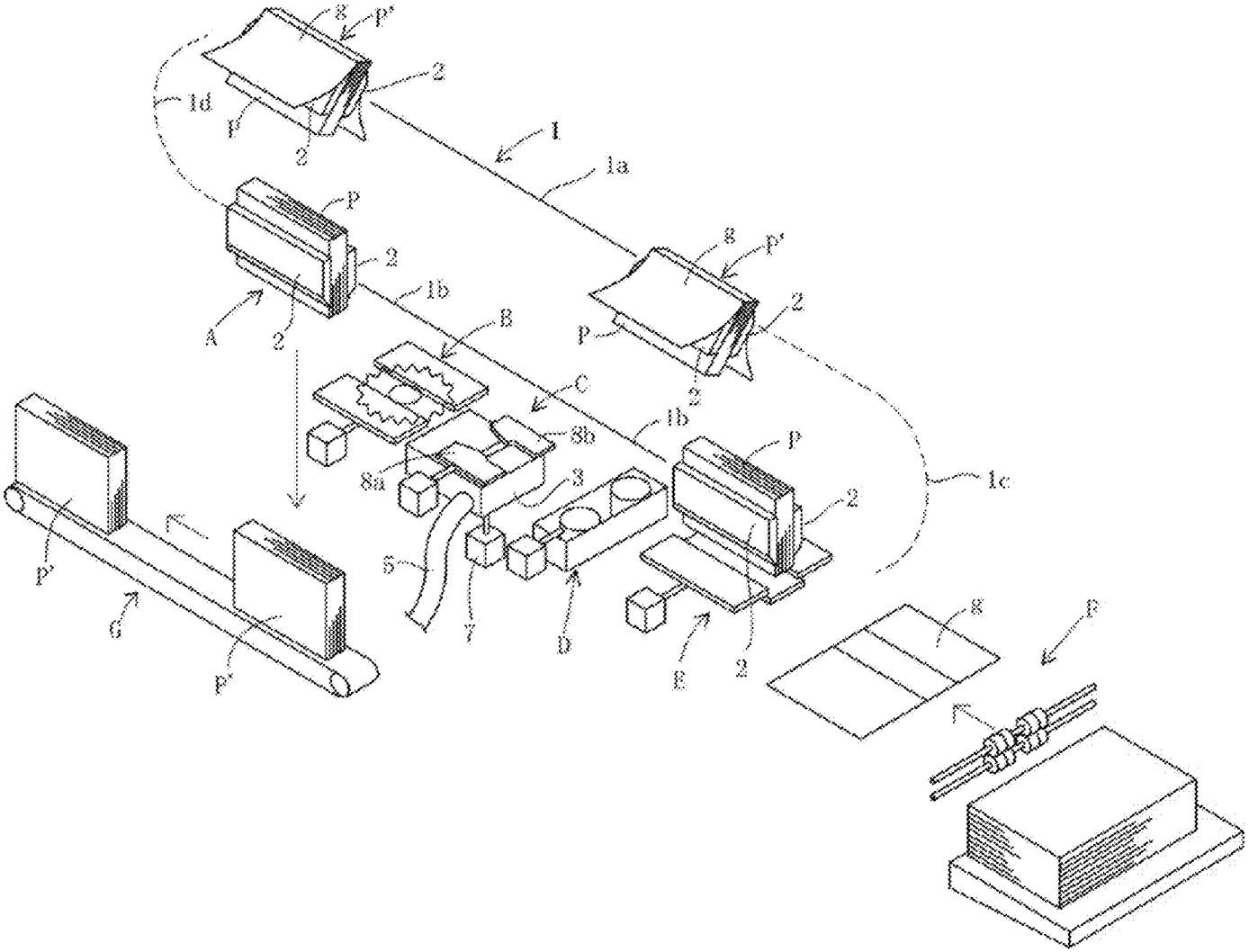
FIG. 1 is a perspective view schematically illustrating a configuration of a bookbinding machine according to an embodiment of the present invention.

FIG. 1 is a perspective view schematically illustrating a configuration of a bookbinding machine according to an embodiment of the present invention.

Referring to FIG. 1, according to the present invention, one or more (in this embodiment, four) clampers 2 adapted to grip a book block P to be bound while keeping the book block P in a standing state are arranged so as to be movable along a predetermined path 1.

In this embodiment, the path 1 of the clampers 2 is a loop path composed of horizontal upper and lower linear path portions 1*a*, 1*b* which are spaced from each other in a vertical plane and arcuate path portions 1*c*, 1*d* which connect ends of the upper and lower linear path portions 1*a*, 1*b*.

Although not shown in the drawings, a guide is arranged along the path 1. The clampers 2 are slidably attached to the guide and movable along the path 1 while being guided by the guide.

The clampers 2 are moved only in one direction (counterclockwise direction in FIG. 1) along the path 1 by an appropriate well-known drive mechanism (not shown).

According to the present invention, a series of processing units (a milling unit B, a nozzle type adhesive application mechanism C, a side adhesive applying unit D and a cover attachment unit E) are arranged along the lower linear path portion 1*b*. In FIG. 1, an alphabet F designates a cover supplying unit supplying a cover g to the cover attachment unit E.

A book block supply position A is provided upstream of the series of processing units B-D on the lower linear path portion 1*b*. The book block supply position A also functions as a product discharge position.

Figure 2:
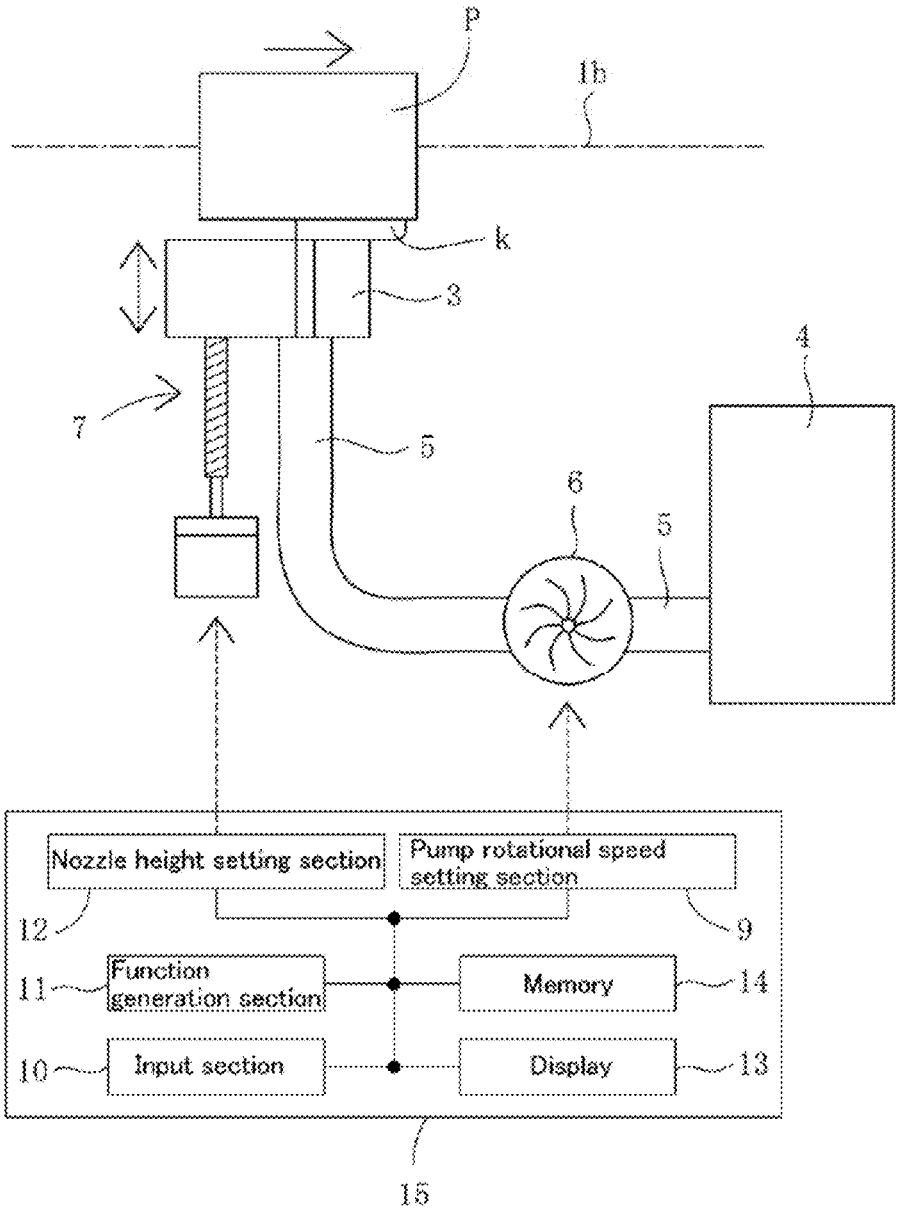
FIG. 2 is a plane view schematically illustrating a configuration of a nozzle type adhesive application mechanism and its controller of the bookbinding machine shown in FIG. 1.

FIG. 2 is a plan view schematically illustrating a configuration of a nozzle type adhesive application mechanism C and its controller.

As shown in FIG. 2, the nozzle type adhesive application mechanism C comprises a spray nozzle 3 upwardly directed toward the lower linear path portion 1*b*, a PUR adhesive supply source 4, an adhesive supply pipe 5 for supplying PUR adhesive from the PUR adhesive supply source 4 to the spray nozzle 3, a pump 6 connected to the adhesive supply pipe 5 to supply the PUR adhesive to the spray nozzle 3, and a nozzle height adjustment mechanism 7 for moving the spray nozzle 3 up and down.

Thus the PUR adhesive k sprayed from the spray nozzle 3 is applied to a spine of the book block P as the book block P is conveyed along the lower linear path portion 1*b* (conveying path) while being guided by a pair of guide plates 8*a*, 8*b* (see, FIG. 1).

In this embodiment, although the PUR adhesive is used as adhesive for bookbinding, adhesive other than the PUR adhesive may be used.

Also, according to the present invention, a pump rotational speed setting section 9 is arranged to calculate a rotational speed coefficient depending on both a thickness of the book block P to be bound and a set value of a conveying speed of the clamper 2 by use of a first function (in this embodiment, a linear function) which defines a relationship between the thickness of the book block and a rotational speed coefficient of the pump 6 (representing the percent change of a rotational speed of the pump 6 relative to the reference rotational speed of the pump 6) and a second function (in this embodiment, a linear function) which defines a relationship between the conveying speed of the clamper 2 and the rotational speed coefficient of the pump 6. The pump rotational speed setting section 9 further calculates a set value of the rotational speed of the pump 6 based on both the rotational speed coefficients and the reference rotational speed of the pump 6, and performs initial setting of the rotational speed of the pump 6 according to the set value of the rotational speed.

The calculation of the set value of the rotational speed of the pump 6 by the pump rotational speed setting section 9 is executed as follows.

Assuming that the reference rotational speed of the pump 6 is $R_0$ when the thickness of the book block P is a predetermined reference value $d_0$ and the conveying speed of the clamper 2 is a predetermined reference value $v_0$ and that the reference rotational speed $R_0$ of the pump 6 is 1, the rotational speed coefficient is defined as the percent change of the rotational speed of the pump 6 relative to the reference rotational speed $R_0$ of the pump 6.

In the pump rotational speed setting section 9, a first rotational speed coefficient $K_t$ depending on the thickness of the book block P is calculated using the first function, and a second rotational speed coefficient $K_v$ depending on the set value of the conveying speed of the clamper 2 is calculated using the second function.

Next, the set value of the rotational speed R of the pump 6 is calculated according to the following equation using the first and second rotational speed coefficients $K_t$ and $K_v$.

$$R=R_0K_tK_v.$$

According to the present invention, the bookbinding machine also comprises an input section 10 for receiving inputs of correction magnifications of the first rotational speed coefficient for two or more different thicknesses of the book block P and/or correction magnifications of the second rotational speed coefficient for two or more different conveying speeds of the clamper 2, and a function generation section 11 generating a third function (in this embodiment, a linear function), which is used for calculating the corrected first rotational speed coefficient depending on the thickness of the book block, based on the correction magnifications of the first rotational speed coefficient inputted into the input section 10, and/or a fourth function (in this embodiment, a linear function), which is used for calculating the corrected second rotational speed coefficient depending on the conveying speed of the clamper, based on the correction magnifications of the second rotational speed coefficient inputted into the input section 10.

In this case, the correction magnifications of the first and second rotational speed coefficients are expressed in percentage (%), so that the correction magnifications of the first and second rotational speed coefficients are 100% in the case of no correction.

Thus, for example, when the correction magnifications of the first and second rotational speed coefficients are inputted into the input section 10 prior to an operation of the bookbinding machine, the third and fourth functions are generated by the function generation section 11, and then the pump rotational speed setting section 9 calculates the corrected first rotational speed coefficient using the third function based on the thickness of the book block P and calculates the corrected second rotational speed coefficient using the fourth function based on the set value of the conveying speed of the clamper 2. Further, the pump rotational setting section 9 calculates the set value of rotational speed of the pump based on the corrected first and second rotational coefficients and the reference rotational speed, and performs the initial setting of the rotational speed of the pump 6 according to the calculated set value of the rotational speed.

Furthermore, for example, when only the correction magnifications of the first rotational speed coefficient are inputted into the input section 10 prior to an operation of the bookbinding machine, only the third function is generated by the function generation section 11. Then the pump rotational speed setting section 9 calculates the corrected first rotational speed coefficient using the third function based on the thickness of the book block P, and calculates the second rotational speed coefficient using the second function based on the set value of the conveying speed of the clamper 2. Further, the pump rotational speed setting section 9 calculates the set value of the rotational speed of the pump 6 based on the corrected first rotational speed coefficient, the second rotational speed coefficient and the reference rotational speed, and then performs the initial setting of the rotational speed of the pump 6 according to the calculated set value of the rotational speed.

For example, when only the correction magnifications of the second rotational speed coefficient are inputted into the input section 10 prior to an operation of the bookbinding machine, only the fourth function is generated by the function generation section 11. Then the pump rotational speed setting section 9 calculates the first rotational speed coefficient using the first function based on the thickness of the book block P, and calculates the corrected second rotational speed coefficient using the fourth function based on the set value of the conveying speed of the clamper 2. Further, the pump rotational speed setting section 9 calculates the set value of the rotational speed of the pump 6 based on the first rotational speed coefficient, the corrected second rotational speed coefficient and the reference rotational speed, and then performs the initial setting of the rotational speed of the pump 6 according to the calculated set value of the rotational speed.

In this embodiment, furthermore, the input section 10 receives inputs of the reference values of the height of the spray nozzle 3 for two or more thicknesses of the book block P, and the function generation section 11 generates a fifth function (in this embodiment, a linear function), which is used for calculating a set value of the height of the spray nozzle 3 depending on the thickness of the book block P, based on the reference values of the height inputted into the input section 10.

Moreover, in this embodiment, the bookbinding machine further comprises a nozzle height setting section 12 calculating a set value of the height of the spray nozzle 3 by use of the fifth function based on the thickness of the book block P, and performing initial setting of the height of the spray nozzle 3 according to the set value of the height.

The pump rotational speed setting section 9, the input section 10, the function generation section 11 and the nozzle height setting section 12 are incorporated into a control section 15 which controls the whole of the bookbinding machine.

The control section 15 has a display 13. The display 13 is in the form of a touch panel display, and the input section 10 comprises a touch screen of this touch panel display and ten keys arranged adjacent to the display 13.

Figure 3:
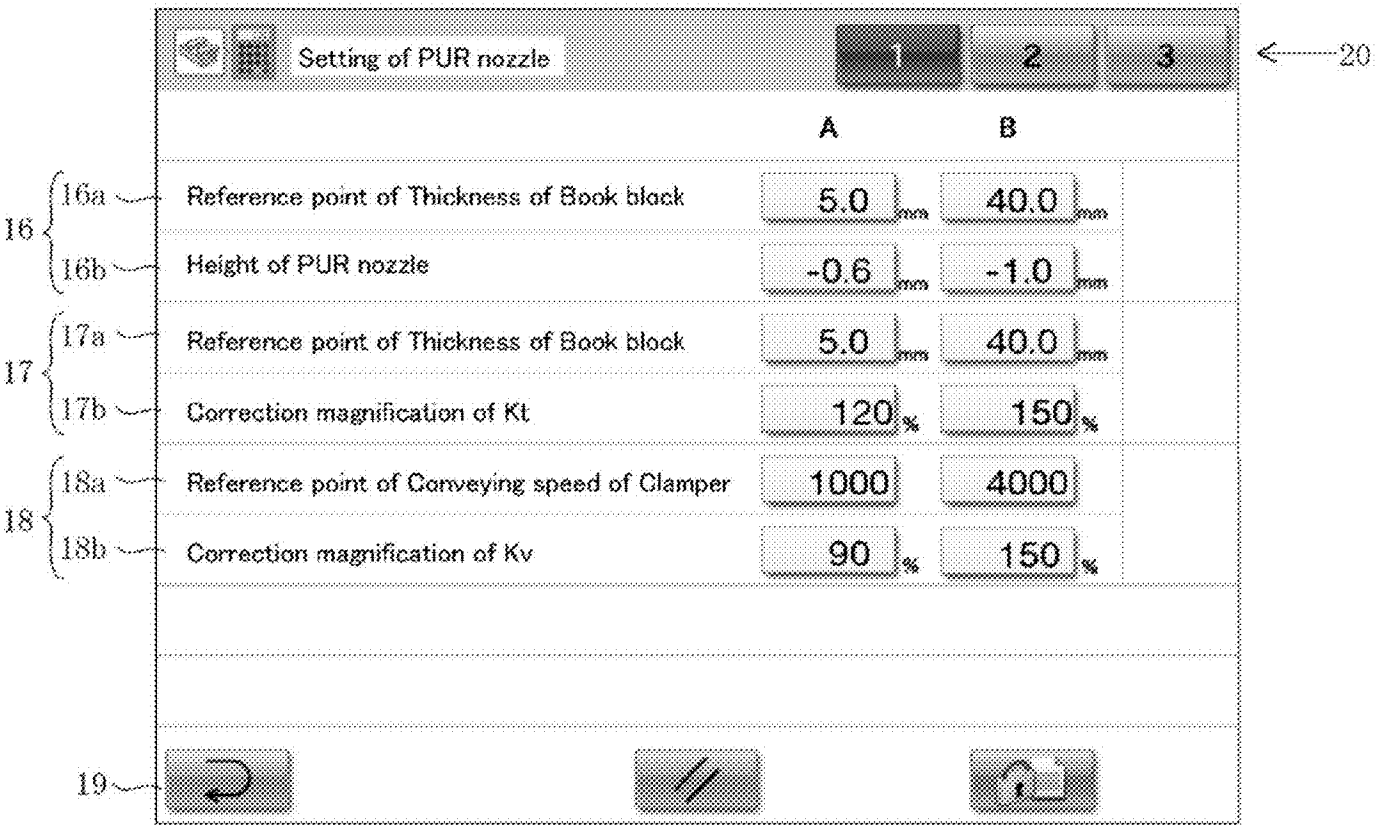
FIG. 3 is a plan view illustrating an example of input screens displayed on a display of the bookbinding machine shown in FIG. 1.

FIG. 3 is a plan view illustrating an example of input screens displayed on a display 13.

Referring to FIG. 3, the input screen is composed of a plurality of rows, and from top to bottom, a first entry field 16 for inputting the reference values of the height of the spray nozzle 3 for two different thicknesses of the book block P, a second entry field 17 for inputting the correction magnifications of the first rotational speed coefficient of the pump 6 for two different thicknesses of the book block P, and a third entry field 18 for inputting the correction magnifications of the second rotational speed coefficient of the pump 6 for two different conveying speeds of the clamper 2 are arranged.

The first to third entry fields 16-18 are divided into two rows, respectively.

A first thickness (in this embodiment, 5.0 mm) of the book block P is inputted in a left column (A column) of an upper row [Reference point of Thickness of Book block] 16*a* of the first entry field 16, and a second thickness (in this embodiment, 40.0 mm) is inputted in a right column (B column) of the upper row [Reference point of Thickness of Book block] 16*a*. On the other hand, the reference value (in this embodiment, −0.6 mm) of the height of the spray nozzle 3 for the first thickness of the book block P is inputted in a left column (A column) of a lower row [Height of PUR nozzle] 16*b* of the first entry field 16, and the reference value (in this embodiment, −1.0 mm) of the height of the spray nozzle 3 for the second thickness of the book block P is inputted in a right column (B column) of the lower row [Height of PUR nozzle] 16*b*.

The minus sign "−" attached to the height of the spray nozzle 3 means that the height is measured downwardly from a position of the spine of the book block P.

The first thickness (in this embodiment, 5.0 mm) of the book block P is inputted in a left column (A column) of an upper row [Reference point of Thickness of Book block] 17*a* of the second entry field 17, and the second thickness (in this embodiment, 40.0 mm) of the book block P is inputted in a right column (B column) of the upper row [Reference point of Thickness of Book block] 17*a*. On the other hand, the correction magnification (in this embodiment, 120%) of the first rotational speed coefficient for the first thickness of the book block P is inputted in a left column (A column) of a lower row [Correction magnification of $K_t$] 17*b* of the second entry field 17, and the correction magnification (in this embodiment, 150%) of the first rotational speed coefficient for the second thickness of the book block P is inputted in a right column (B column) of the lower row [Correction magnification of $K_t$] 17*b*.

When the rotational speed of the pump 6 is not changed from a preset value, the numerical value "100%" as the correction magnification of the first rotational speed coefficient is inputted. When the numerical value "100%" is inputted in both the A and B columns of the lower row [Correction magnification of $K_t$] 17*b* of the second entry field 17, it is determined that the correction magnification of the first rotational speed coefficient was not inputted, and accordingly the first rotational speed coefficient depending on the thickness of the book block P is calculated using the first function.

A first conveying speed (in this embodiment, 1000 volumes/hour) of the clamper 2 is inputted in a left column (A column) of an upper row [Reference point of Conveying speed of Clamper] 18*a* of the third entry field 18, and a second conveying speed (in this embodiment, 4000 volumes/hour) of the clamper 2 is inputted in a right column (B column) of the upper row [Reference point of Conveying speed of Clamper] 18*a*. The correction magnification (in this embodiment, 90%) of the second rotational speed coefficient for the first conveying speed of the clamper 2 is inputted in a left column (A column) of a lower row [Correction magnification of $K_v$] 18*b* of the third entry field 18, and the correction magnification (in this embodiment, 150%) of the second rotational speed coefficient for the second rotational speed of the clamper 2 is inputted in a right column (B column) of the lower row [Correction magnification of $K_v$] 18*b*.

When the rotational speed of the pump 6 is not changed from a preset value, the numerical value "100%" as the correction magnification of the second rotational speed coefficient is inputted. When the numerical value "100%" is inputted in both the A and B columns of the lower row [Correction magnification of $K_v$] 18*b* of the third entry field 18, it is determined that the correction magnification of the second rotational speed coefficient was not inputted, and accordingly the second rotational speed coefficient depending on the thickness of the book block P is calculated using the second function.

When a return key 19 displayed lower left on the input screen is pressed after the numerical values are inputted in the first through third entry fields 16-18 on the screen, those numerical values are inputted into the input section 10.

Then, in the function generation section 11, the third through fifth functions are generated based on the numerical values inputted into the input section 10.

In this embodiment, further, as shown in FIG. 3, switching tabs 20 (indicated by numerals "1" through "3") for switching input screen areas are attached to the top of the input screen. Plural sets of numerical values (in this embodiment, three sets of numerical values) can be inputted into the input section 10 by switching the switching tabs 20.

Also, the control section 15 includes a memory 14 and the plural sets of the numerical values are stored in the memory 14.

Thus one of the plural sets of the numerical values is selected by choice of switching tabs 20 on the input screen, and the selected set of the numerical values are inputted into the input section 10 by pressing the return key 19. The function generation section 11 generates functions using the inputted set of the numerical values.

Thereby a user can perform an data input operation more easily in a short time.

Next, details of an operation of the function generation section 11 will be explained with reference to the accompanying drawings.

Figure 4:
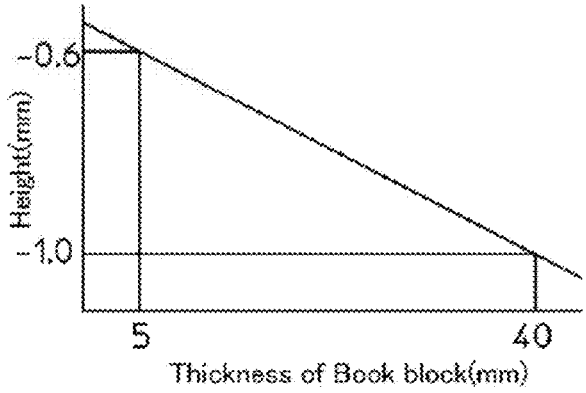
FIGS. 4(A) to 4(C) are views showing examples of graphs of functions generated in the bookbinding machine shown in FIG. 1.
Figure 4:
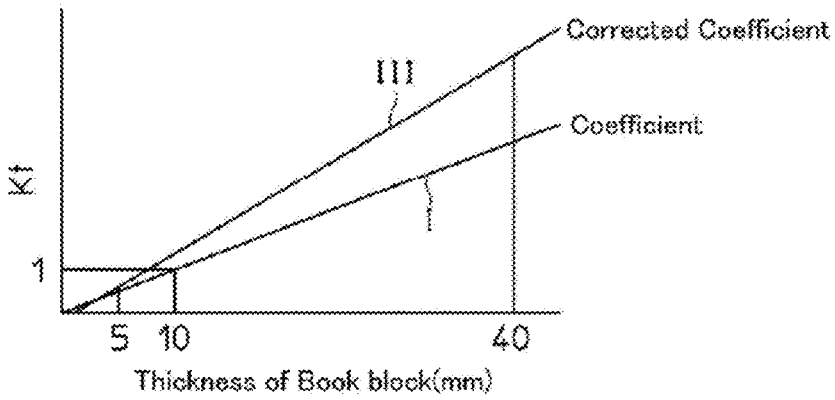
Figure 4:
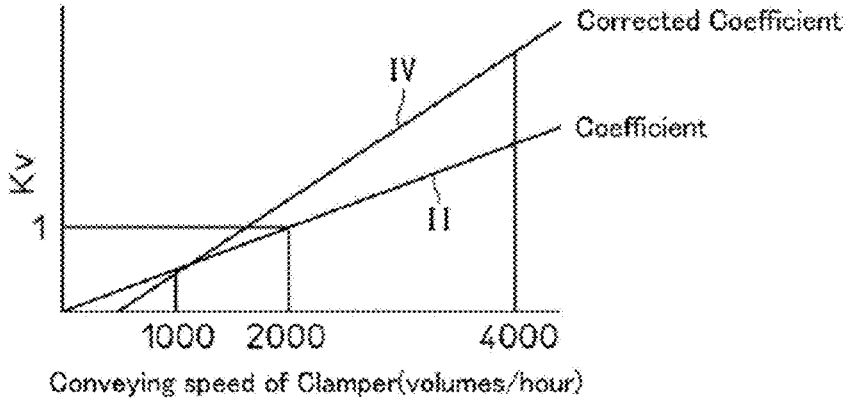

FIG. 4(A) is a view showing an example of the fifth function. In the graph shown in FIG. 4(A), a vertical axis represents the height (mm) of the spray nozzle 3 and a horizontal axis represents the thickness (mm) of the book block P. Here, the minus sign "−" attached to the height of the spray nozzle 3 means that the height is measured downwardly from the position of the spine of the book block P.

Referring to FIG. 4(A), in this embodiment, the reference values (−0.6 mm, −1.0 mm) of the height of the spray nozzle 3 for two different thicknesses of the book block P (5 mm, 40 mm) are inputted into the input section 10 (see, FIG. 3), and, in the function generation section 11, the fifth function is generated based on the two thicknesses of the book block P and the corresponding reference values of the height of the spray nozzle 3.

The generation of the fifth function is performed by setting an X-Y coordinate system in which an X-axis represents the thickness of the book block P and a Y-axis represents the height of the spray nozzle 3 and deriving an equation of a straight line which passes through a point A (5 mm, −0.6 mm) and a point B (40 mm, −1.0 mm).

FIG. 4(B) is a view showing examples of graphs of the first and third functions. In the graphs shown in FIG. 4(B), a vertical axis represents the first rotational speed coefficient $K_t$, a horizontal axis represents the thickness (mm) of the book block P, a straight line (I) represents the first function and a straight line (III) represents the third function.

A scale of the vertical axis is defined as a ratio of the rotational speed of the pump 6 to $R_0$ when $R_0$ is 1, assuming that the rotational speed of the pump 6 is the reference rotational speed $R_0$ when the thickness of the book block P is 10 mm.

Referring to FIG. 4(B), in this embodiment, the correction magnifications (120%, 150%) of the first rotational speed coefficient $K_t$ for two different thicknesses of the book block P (5 mm, 40 mm) are inputted into the input section 10 (see, FIG. 3), and, in the function generation section 11, the third function (III) is generated based on the two thicknesses of the book block P and the corresponding correction magnifications of the first rotational speed coefficient $K_t$.

Figure 5:
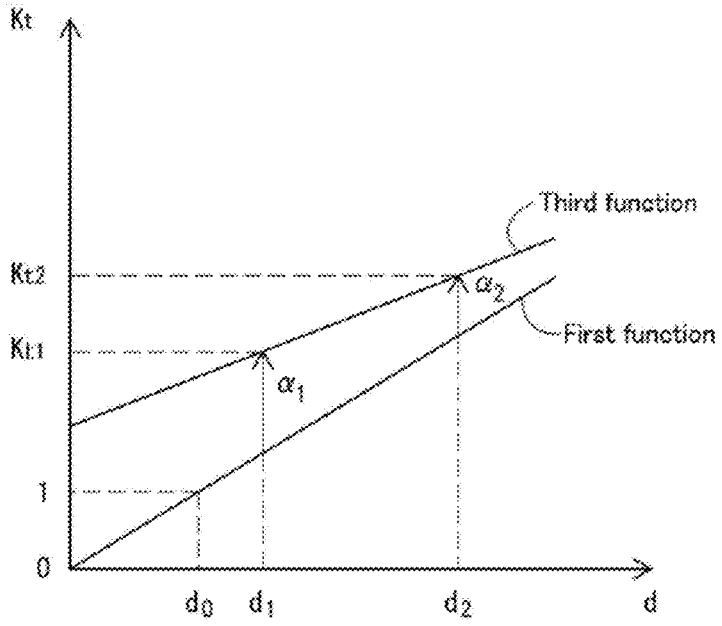
FIG. 5 is a view showing a graph for explaining a process of generation of a third function in a function generation section of the bookbinding machine shown in FIG. 1.

FIG. 5 is a view showing a graph for explaining a process of generation of the third function (III) in the function generation section 11. In the graph shown in FIG. 5, a vertical axis represents the first rotational speed coefficient $K_t$ and a horizontal axis represents the thickness d of the book block P.

Referring to FIG. 5, assuming that the correction magnifications $a_1$ and $a_2$ are inputted for the thicknesses $d_1$ and $d_2$, respectively, because the first function (I) is given by $$K_t = \frac{1}{d_0} d, \tag{1}$$

$K_{t1}$ and $K_{t2}$ are $$K_{t1} = \frac{d_1 \alpha_1}{d_0} \text{ and}$$

$$K_{t2} = \frac{d_2 \alpha_2}{d_0},$$

respectively.

Thus a slope (a) of the third function (III) is obtained as $$a = \frac{K_{t2} - K_{t1}}{d_2 - d_1} = \frac{\alpha_2 d_2 - \alpha_1 d_1}{d_0 (d_2 - d_1)},$$

Assuming that the third function (III) is expressed by $$K_t = \frac{\alpha_2 d_2 - \alpha_1 d_1}{d_0 (d_2 - d_1)} d + b. \tag{2}$$

because the third function (III) passes through a point ($d_1$, $K_{t1}=d_1\alpha_1/d_0$), a constant (b) of the equation (2) is obtained by substituting a coordinate of this point into the equation (2) and solving the equation (2) for the constant (b):

$$b = \frac{d_1 d_2 (\alpha_1 - \alpha_2)}{d_0 (d_2 - d_1)}.$$

Thus the third function (III) is obtained (generated) as $$K_t = \frac{(\alpha_2 d_2 - \alpha_1 d_1) d + d_1 d_2 (\alpha_1 - \alpha_2)}{d_0 (d_2 - d_1)}. \tag{3}$$

FIG. 4(C) is a view showing examples of graphs of the second and fourth functions. In the graphs shown in FIG. 4(C), a vertical axis represents the second rotational speed coefficient $K_v$, a horizontal axis represents the conveying speed (volumes/hour) of the clamper 2, a straight line (II) represents the second function and a straight line (IV) represents the fourth function.

A scale of the vertical axis is defined as a ratio of the rotational speed of the pump 6 to $R_0$ when $R_0$ is 1, assuming that the rotational speed of the pump 6 is the reference rotational speed $R_0$ when the conveying speed of the clamper 2 is 2000 volumes/hour.

Referring to FIG. 4(C), in this embodiment, the correction magnifications (90%, 150%) of the second rotational speed coefficient $K_v$ for two different conveying speeds (1000 volumes/hour, 4000 volumes/hour) of the clamper 2 are inputted into the input section 10 (see, FIG. 3), and, in the function generation section 11, the fourth function (IV) is generated based on the two conveying speeds of the clamper 2 and the corresponding correction magnifications. The fourth function (IV) is generated in the same manner as in generation of the third function (III).

The first through fifth functions generated by the function generation section are not limited to this embodiment, and these functions may be appropriate functions other than a linear function.

The information about the thickness of the book block P to be bound is obtained by a well-known device for measuring a thickness of a book block (not shown) attached to the bookbinding machine or provided independently of the bookbinding machine. The measurement value is received by the control section 15.

The conveying speed of the clamper 2 is inputted into the control section 15 at initial setting of the bookbinding machine.

In the bookbinding machine, the rotational speed coefficient depending on both the thickness of the book block to be bound and the set value of the conveying speed of the clamper is calculated using the first function which defines the relationship between the thickness of the book block and the rotational speed coefficient of the pump (representing the percent change of the rotational speed of the pump relative to the reference rotational speed of the pump) and the second function which defines the relationship between the conveying speed of the clamper and the rotational speed coefficient of the pump, and the set value of the rotational speed of the pump is calculated based on the rotational speed coefficient and the reference rotational speed, and then the initial setting of the rotational speed of the pump is automatically performed according to the set value of the rotational speed, thereby an easy and quick initial setting of the nozzle type adhesive application mechanism is achieved so that user's workload is reduced considerably.

When just the rotational speed of the pump automatically set using preset first and second functions cannot meet a user's needs, the user preliminarily inputs the correction magnifications of the first rotational speed coefficient and/or the correction magnifications of the second rotational speed coefficient into the input section 10. Consequently, in the function generation section 11, the third function for calculating the corrected first rotational speed coefficient depending on the thickness of the book block P, and/or the fourth function for calculating the corrected second rotational speed coefficient depending on the conveying speed of the clamper 2 are (is) generated.

Thereby, before the start of an operation of the bookbinding machine, the corrected first rotational speed coefficient depending on the thickness of the book block P to be bound is calculated using the third function, and/or the corrected second rotational speed coefficient depending on the conveying speed of the clamper 2 is calculated using the fourth function, and then the set value of the rotational speed of the pump 6 is calculated using the corrected first and/or second rotational speed coefficient(s), and the set value of the rotational speed of the pump 6 is calculated using the corrected first and/or second rotational speed coefficient(s), so that an initial setting of the rotational speed of the pump 6 is performed according to the set value of the rotational speed.

Furthermore, in the nozzle height setting section 12, the set value of the height of the spray nozzle 3 depending on the thickness of the book block P to be bound is calculated using the fifth function, and an initial setting of the height of the spray nozzle 3 is performed according to the set value of the height.

According to the present invention, an easy and quick initial setting of the nozzle type adhesive application mechanism C is achieved so that user's workload is reduced considerably.

Also, prior to the start of the operation of the bookbinding machine, initial settings of the clamper 2, the milling unit B, the side adhesive applying unit D, the cover attachment unit E and the cover supplying unit F are performed as well as the initial setting of the nozzle type adhesive application mechanism C.

After starting the operation of the bookbinding machine, every time the clamper 2 reaches and stops at the book block supply position A, the clamper 2 takes an open position and the book block P is supplied with a spine thereof facing downward from a book block supply unit (not shown) to the clamper 2, and then the clamper 2 takes a closed position to grip the book block P.

Thereafter, the clamper 2 leaves the book block supply position A and moves to the milling unit B. The spine of the book block P is cut while the book block P gripped by the clamper 2 passing through the milling unit B. Next, the book block P gripped by the clamper 2 is conveyed to the nozzle type adhesive application mechanism C.

While the book block P gripped by the clamper 2 passes through the spray nozzle 3 with guide by the pair of guide plates 8*a*, 8*b* of the nozzle type adhesive application mechanism C, the PUR adhesive is applied from the spray nozzle 3 to the spine of the book block P in a predetermined thickness.

When the application of adhesive is completed, the book block P gripped by the clamper 2 is conveyed to the cover attachment unit E through the side adhesive applying unit D.

In the cover attachment unit E, the cover is attached to the spine of the book block P so that a product P' is completed.

Thereafter, the product P' reaches and stops at the book block supply position A through the arcuate path portion 1*c*, the upper linear path portion 1*a* and the arcuate path portion 1*d* while being gripped by the clamper 2, where the clamper 2 takes the open position to fall the product P' on the product discharge unit G, and the product P' is discharged to the outside of the bookbinding machine.

Although a preferred embodiment of the present invention has been explained, the present invention is not limited to the above-mentioned embodiment and one skilled in the art can easily create a variety of modifications within the scope of the attached claims.

For example, according to the above-mentioned embodiment, at initial settings of the bookbinding machine, not only the rotational speed of the pump 6 is adjusted depending on both the thickness of the book block P to be bound and the conveying speed of the clamper 2, but also the height of the spray nozzle 3 is adjusted depending on the thickness of the book block P to be bound, but, according to another embodiment, only the rotational speed of the pump 6 is adjusted depending on only the thickness of the book block P to be bound at the initial settings.

In this case, the input section 10 receives only an input of the correction magnifications of the first rotational speed coefficient of the pump 6, the function generation section 11 generates only the third function, and when the correction magnifications of the first rotational speed coefficient are inputted into the input section 10 before the start of the operation of the bookbinding machine, the pump rotational speed setting section 9 calculates the corrected first rotational speed coefficient from the third function based on the thickness of the book block P to be bound, and calculates the set value of the rotational speed of the pump 6 based on the reference rotational speed and the corrected first rotational speed coefficient, and performs the initial setting of the rotational speed of the pump 6 according to the set value of the rotational speed.

Alternatively, only the rotational speed of the pump 6 may be adjusted depending on only the conveying speed of the clamper 2 at the initial settings.

In this case, the input section 10 receives only input of the correction magnifications of the second rotational speed coefficient of the pump 6, and the function generation section 11 generates only the fourth function, and when the correction magnifications of the second rotational speed coefficient are inputted into the input section 10 before the operation of the bookbinding machine, the pump rotational speed setting section 12 calculates the corrected second rotational speed coefficient from the fourth function based on the set value of the conveying speed of the clamper 2 and calculates the set value of the rotational speed of the pump 6 based on the reference rotational speed and the corrected second rotational speed coefficient and performs the initial setting of the rotational speed of the pump 6 using the set value of the rotational speed.

For example, although the height of the spray nozzle 3 is adjusted depending on the thickness of the book block P to be bound at the initial settings in the above-mentioned embodiment, this configuration of adjustment of the height of the spray nozzle 3 is provided, if necessary.

In the above-mentioned embodiment, the rotational speed of the pump 6 may be set depending on not only the thickness of the book block P to be bound and the set value of the conveying speed of the clamper 2 but also the set value of the height of the spray nozzle 3.

In this configuration, the pump rotational speed setting section 9 not only calculates the first rotational speed coefficient depending on the thickness of the book block P to be bound by use of the first function and the second rotational speed coefficient depending on the set value of the conveying speed of the clamper 2 by use of the second function, but also calculates a third rotational speed coefficient depending on the set value of the height of the spray nozzle 3 by use of a sixth function which defines a relationship between the height of the spray nozzle 3 and the third rotational speed coefficient representing the percent change of the rotational speed of the pump 6 relative to the reference rotational speed of the pump 6, thereafter calculates the set value of the rotational speed of the pump 6 based on the first through third rotational speed coefficients and the reference rotational speed of the pump 6, and performs the initial setting of the rotational speed of the pump 6 according to the set value of the rotational speed.

Also, in this configuration, the input section 10 can receive the input of the correction magnifications of the first rotational speed coefficient for two different thicknesses of the book block P, the correction magnifications of the second rotational speed coefficient for two different conveying speeds of the clamper 2 and the correction magnifications of the third rotational speed coefficient for two different heights of the spray nozzle 3.

The function generation section 11 also generates not only the third and fourth functions but also a seventh function for calculating the corrected third rotational speed coefficient depending on the height of the spray nozzle 3 based on the correction magnification of the third rotational speed coefficient.

Figure 6:
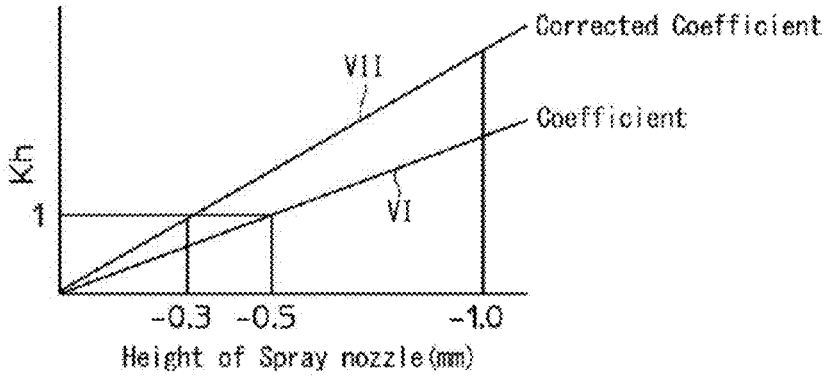
FIG. 6 is a view showing an example of graphs of functions generated in a modification of the bookbinding machine shown in FIG. 1.

FIG. 6 is a view showing an example of graphs of the sixth and seventh functions. In the graphs shown in FIG. 6, a vertical axis represents the third rotational speed coefficient $K_h$, a horizontal axis represents the height (mm) of the spray nozzle 3, a straight line (VI) represents the sixth function and a straight line (VII) represents the seventh function.

A scale of the vertical axis is defined as a ratio of the rotational speed of the pump 6 to $R_0$ when $R_0$ is 1, assuming that the rotational speed of the pump 6 is the reference rotational speed $R_0$ when the height of the spray nozzle 3 is −0.5 mm.

Further, in this configuration, when the correction magnifications of the first through third rotational speed coefficients are inputted into the input section 10 before the operation of the bookbinding machine, the pump rotational speed setting section 9 calculates the corrected first rotational speed coefficient from the third function based on the thickness of the book block P to be bound and calculates the corrected second rotational speed coefficient from the fourth function based on the set value of the conveying speed of the clamper 2 and calculates the corrected third rotational speed coefficient from the seventh function based on the set value of the height of the spray nozzle 3, thereafter calculates the set value of the rotational speed of the pump 6 based on the corrected first through third rotational speed coefficients and the reference rotational speed, and then performs the initial setting of the rotational speed of the pump 6 according to the set value of the rotational speed.

DESCRIPTION OF REFERENCE NUMERALS

1 Path
1*a* Upper linear path portion
1*b* Lower linear path portion
1*c*, 1*d* Arcuate path portion
2 Clamper
3 Spray nozzle
4 PUR adhesive supply source
5 Adhesive supply pipe
6 Pump
7 Nozzle height adjustment mechanism
8*a*, 8*b* Guide plate
9 Pump rotational speed setting section
10 Input section
11 Function generation section
12 Nozzle height setting section
13 Display
14 Memory
15 Control section
16 First entry field
16*a* Upper row
16*b* Lower row
17 Second entry field
17*a* Upper row
17*b* Lower row
18 Third entry field
18*a* Upper row
18*b* Lower row
19 Return key
20 Switching tab A Book block supply position
B Milling unit
C Nozzle type adhesive application mechanism
D Side adhesive applying unit
E Cover attachment unit
F Cover supplying unit
G Product discharge unit
g Cover
k PUR adhesive
P Book block
P' Product

The invention claimed is:

1. A bookbinding machine comprising:

a nozzle type adhesive application mechanism arranged under a path of conveying a book block to be bound, the nozzle type adhesive application mechanism comprising:

a spray nozzle directed toward the path;

an adhesive supply source;

an adhesive supply pipe for supplying adhesive from the adhesive supply source to the spray nozzle and;

a pump connected to the adhesive supply pipe;

at least one damper adapted to grip the book block while keeping the book block in a standing state and convey the book block along the path, a pump rotational speed setting section calculating a rotational speed coefficient depending on both of a thickness of the book block and a set value of a conveying speed of the at least one damper by use of first and second functions, the rotational speed coefficient representing the percent change of a rotational speed of the pump relative to the reference rotational speed of the pump, the first function defining a relationship between the thickness of the book block and the rotational speed coefficient, the second function defining a relationship between the conveying speed of the at least one damper and the rotational speed coefficient; the pump rotational speed setting section further calculating a set value of the rotational speed of the pump based on both the rotational speed coefficient and the reference rotational speed of the pump, and performing initial setting of the rotational speed of the pump according to the set value of the rotational speed, a first input section for receiving inputs of correction magnifications of the rotational speed coefficient for two or more different thicknesses of the book block; and a first function generation section generating as an alternative to the first function a third function based on the correction magnifications inputted into the first input section, the third function being used for calculating the corrected rotational speed coefficient depending on the thickness of the book block, wherein, when the correction magnifications of the rotational speed coefficient are inputted into the first input section prior to an operation of the bookbinding machine, the pump rotational speed setting section calculates the corrected rotational speed coefficient depending on the thickness of the book block using the third function, and further calculates the set value of the rotational speed of the pump based on the corrected rotational speed coefficient, and the rotational speed coefficient depending on the set value of the conveying speed of the at least one damper calculated using the second function, and the reference rotational speed.

2. The bookbinding machine according to claim 1, further comprising:

a second input section for receiving inputs of correction magnifications of the rotational speed coefficient for two or more different conveying speeds of the at least one damper; and a second function generation section generating as an alternative to the second function a fourth function based on the correction magnifications inputted into the second input section, the fourth function being used for calculating the corrected rotational speed coefficient depending on the conveying speed of the at least one damper, wherein, when the correction magnifications of the rotational speed coefficient are inputted into the second input section prior to an operation of the bookbinding machine, the pump rotational speed setting section calculates the corrected rotational speed coefficient depending on the set value of the conveying speed of the at least one clamper using the fourth function, and further calculates the set value of the rotational speed of the pump based on the corrected rotational speed coefficient, and the rotational speed coefficient depending on the thickness of the book block calculated using the first or third function, and the reference rotational speed.

* * * * *